US005796337A

United States Patent [19]

Wachsman

[11] Patent Number: 5,796,337

[45] **Date of Patent: *Aug. 18, 1998**

[54] ELECTRONIC SECURITY CLIP DEVICE

[75] Inventor: David R. Wachsman, Dix Hills, N.Y.

[73] Assignee: Protex International Corp., Bohemia, N.Y.

[ * ] Notice: The term of this patent shall not extend beyond the expiration date of Pat. No. 5,345,220.

[21] Appl. No.: 673,373

[22] Filed: Jun. 28, 1996

Related U.S. Application Data

[63] Continuation of Ser. No. 281,459, Jul. 27, 1994, abandoned, which is a continuation-in-part of Ser. No. 897,707, Jun. 12, 1992, Pat. No. 5,345,220.

[51] Int. Cl.[6] ..... G08B 70/59

[52] U.S. Cl. ..... 340/568; 340/571; 70/59

[58] Field of Search ..... 340/568, 687, 340/571, 572; 70/59; 24/505, 517, 527, 542, 568, 493, 500, 511, 512, 514; 200/61.13

[56] References Cited

U.S. PATENT DOCUMENTS 3,649,954 3/1972 Kurtz ..... 339/95 R 4,616,113 10/1986 Janic ..... 200/61.13

5,345,220 9/1994 Wachsman ..... 340/568

*Primary Examiner*—Jeffery Hofsass

*Assistant Examiner*—Albert K. Wong

*Attorney, Agent, or Firm*—Eugene E. Renz, Jr.

[57] ABSTRACT

An electronic security clip device to protect merchandise, for use with an electronic security system activated by an alarm signal. The device includes a switch for controlling the alarm signal and a cable for transmitting the alarm signal from the switch to the electronic security system. A pair of pivotally mounted jaws are biased in a closed position, having confronting faces disposed in a common plane when in a closed position so that the switch is in operable relationship with the jaws upon the placement of merchandise between the jaws. Removal of the merchandise causes the switch to generate the alarm signal, thereby activating the electronic security system. A locking device is provided on the jaws that is selectively movable between a first condition preventing relative movement of the jaws with respect to one another and a second condition permitting the relative movement.

5 Claims, 5 Drawing Sheets

ELECTRONIC SECURITY CLIP DEVICE

This is a continuation of application(s) Ser. No. 08/281,459 filed on Jul. 27, 1994, now abandoned which is a continuation-in-part of application Ser. No. 07/897,707 filed Jun. 12, 1992, now issued as U.S. Pat. No. 5,345,220.

FIELD OF THE INVENTION

The present invention relates to a clip for an electronic security system which is particularly adapted for providing protection against shoplifting of merchandise such as garments displayed on garment fixtures or racks. More particularly, the present invention provides a fastening device for use with electronic security devices which is of comparatively simplified construction and is characterized by novel features of construction and arrangement providing versatile adaptation to existing furnishings and store fixtures in garment display sections of stores while providing maximum accessibility to individual items of merchandise or apparel displayed on the racks or fixtures.

BACKGROUND OF THE INVENTION

Clothing sales are primarily made by displaying the garments on open racks such that customers may put on the clothing to determine proper fit and may view themselves in the clothing to determine the appropriate aesthetic appeal. However, nicer items such as suits and coats or other outer wear garments have a relatively high value, and concern for security is important. Accordingly, efforts have been made to reduce the likelihood of theft or other unauthorized removal of the garments from the store.

Security devices for garments are, of course, not new per se. A number of systems have been proposed which allow the potential customer to inspect the items in a display rack or fixture without setting off an alarm and at the same time preventing the removal of the item from the immediate vicinity of the display. A typical system involves the step of threading a single steel cable through all the garments on a particular rack, such that the ends of the cable are secured by a locking mechanism to the rack. This system has an obvious drawback in that garments are not capable of being put on by the customer nor are they capable of being purchased until such cable is removed. That is not convenient, even if the desired garment is close to the end of the cable. Particularly with jackets and coats, such a removal and reinsertion process for the steel cable is both time consuming and not conductive to what are called impulse sales.

Attaching an individual cable to each garment is a known way to resolve the difficulties of collective security attachment. It is desirable that a customer be able to select a number of garments from a rack of clothing, try on the several garments, and reach the point of decision to purchase a particular item. One system which has been found to be effective for both security and display of clothing is described in U.S. Pat. No. 4,598,827. This system includes a housing in which a plurality of cables are employed, with each cable being attached at one end to the garment and at the other end to the housing. The attachment to the housing is detachable, such that any one or more individual cables can be removed or attached to the housing without disturbing the other cable attachments.

One method of attaching the cable to the garment is shown in this patent, where a cable is passed through an opening such as a buttonhole in the garment, where the cable has an enlarged plastic button at one end to prevent that end from passing through the opening. The other end of the cable is then attached to the security monitoring housing. The problem with this system, which has been effective up to a point, is that the method for attaching the cable to the goods is awkward and does not include an electronic feature so as to sound an alarm if tampered with. Thus, the cable shown in this patent is not secure against cutting, and would not send an alarm if cut and removed from the garment.

Another system of garment security and protection is shown in U.S. Pat. No. 4,620,182. In this system, an alarm mechanism is employed for signaling a closed circuit condition, such as when the cable which mechanically connects the retail item to the security device is cut. This system has been found to be effective in securing garments which have been displayed on a rack or other store fixture by attaching to the garment as in the prior patent discussed above and to the housing by plugging the other end of the cable into a jack or other electrically connecting fixture. It is intended that the present invention improve this system by a new and improved device for connecting the cable to the object for which security is sought.

In this system, the cable is also sensitive to being cut and will sound an alarm via the disclosed electronic circuitry when, for example, a pair of conductive elements are contained in the cable and complete a circuit when joined together by actions such as cutting of the cable. The system is very effective in some situations, but concern for attachment of the cable to the goods still exists. There is no provision for an alarm to be sounded when the cable is removed from the object, since that attachment is not, in fact, electronically sensitive.

None of the prior art systems provide for complete security, particularly for the attachment of the cable to the object of interest. This has been found to be a major point where the security system is likely to fail, either from inattentive or careless use by the sales personnel. It is also important that the overall security not be disturbed each time one garment is removed from the system, such as when one garment has been sold. It is also important that the cable be attached to the goods in a manner that does not easily become unattached by accident or misadventure.

Accordingly, it is a primary object of the present invention to provide a security system for garments such as jackets and coats and the like which allows for access to each individual item on the display rack or fixture.

Another object of this invention is to provide a system in which individual cables are attached to garments at one end and is secured to the security system at the other end of the cable in such a manner as to permit easy attachment and removal of the cable to the goods only upon authorized access to the junction of the cable and the goods.

Yet another object of the present invention is to provide a system in which the cable and security housing connection is resistant to efforts to disabled tampering with the connection to the goods.

Still another object is to provide a connecting device for a security cable that does not disengage merely upon one action by a person inspecting the goods to which it is attached.

Other objects will appear hereinafter.

SUMMARY OF THE INVENTION

It has now been discovered that the above and other objects of the present invention may be accomplished in the following manner. Specifically, the present invention provides an electronic security system and an electronic security clip device for use with such security systems. The security system is suitable for many objects but is shown herein for use with garments and the like which are mounted for display on a display fixture.

The electronic alarm box includes a plurality of cable receiving jacks for receiving cables from individual objects. The alarm box is adapted to sound an alarm upon receipt of an alarm signal. At least one cable having the electronic security clip device of this invention is attached at one end to the cable receiving jacks. The other end of the cable has a clip which is attached to an object on a display fixture.

The electronic security clip device of the present invention may be employed with other security systems, since it is capable of generating a signal if any attempt is made to take the clip from the object to which it is attached without disarming the alarm device. In its simplest form, the clip device includes a pair of opposing jaws which are pivotably mounted on the clip means in a normally closed position, such that the clip means positions the alarm in operable relationship with the jaws.

Included within the clip is a cable and alarm means including switch means for activating the alarm upon placement of an object between the jaws. Removal of the object then causes the switch to trigger the cable and alarm means to transmit the alarm signal to the alarm box, resulting in an alarm unless the alarm has been temporarily deactivated by a sales clerk or other authorized person.

The clip is formed from a clip base which has a pair of upwardly facing cam surfaces and a positioning support ridge. A lower jaw is pivotably mounted on the clip base and has a shoulder for engaging the support ridge to positioning the lower jaw in the clip base. The lower jaw includes a lower jaw face and a chamber or slot for positioning the cable and alarm means in operable relationship to the lower jaw face. An upper jaw is pivotably mounted on the clip base and also has a pair of downwardly facing cam surfaces for mutual engagement with the clip base. The upper jaw has an upper jaw face aligned to engage the lower jaw face to thereby engage the garment or other object. Biasing means in the form of a spring or the like are provided for positioning the upper and lower jaws in a normally closed position. The upwardly facing cam surfaces and the downwardly facing cam surfaces are aligned to permit pivotal separation of the upper jaw and lower jaw upon pressure to overcome the biasing means.

The alarm means includes a switch with a spring biased probe that extends from the lower jaw toward the upper jaw which in turn has a probe receiving socket for receiving the probe in the normally closed position. The probe is adapted to be moved inward to an alarm position to cause the alarm means to be ready to operate upon placement of an object between the upper jaw face and the lower jaw face such that removal of the object causes the probe to trigger the alarm and thereby transmit the alarm signal to the alarm box.

In a preferred embodiment, at least one of the upper and lower jaw faces includes a garment engaging surface on the face to prevent slidable movement of the object from between the jaw faces. Also preferred is an embodiment where the switch comprises a micro switch adapted to generate the signal upon movement of the probe outwardly from the alarm position.

Another preferred embodiment includes the adaptation of the upper jaw so that it extends into the clip base in the normally closed position to prevent interposition of an object between the probe and an object between the jaws without overcoming the biasing means.

The clip includes locking means on the jaws thereof that is selectively movable between a first condition preventing relative movement of the jaws and a second condition permitting that relative movement. Two specific embodiments are shown to be effective.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
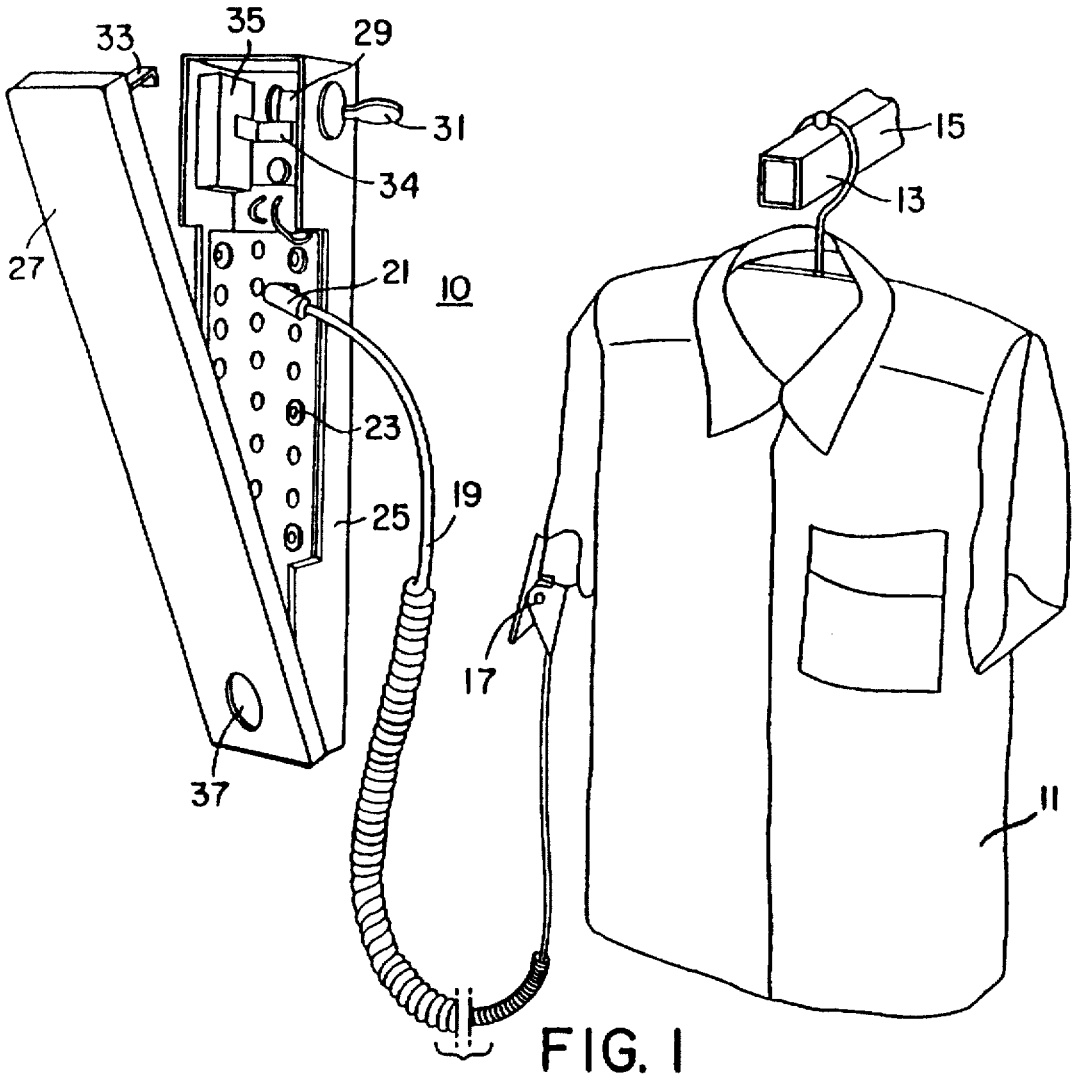
FIG. 1 is a pictorial view illustrating a security system in which the electronic security clip device of the present invention is employed.

As shown in the drawings, a security system, 10 generally, is intended for use with a garment 11 which is hung on a hanger 13 held by a clothes rack 15 or other display fixtures. Of course, other objects and other display fixtures are equally suitable for use with the present invention, and the particular hanger and rack are merely illustrative.

The principle feature of the present invention includes the use of an electronic security clip device, shown in FIG. 1 as 17. The clip 17 is attached at one end to a cable 19, which in turn is plugged into an alarm box by insertion of molded plug end 21 into an internal jack 23 of alarm box 25. Alarm box 25 is preferably shown in the above mentioned U.S. Pat. No. 4,620,182, the disclosure of which is incorporated herein by reference. The alarm box, which may be mounted to any adjacent structure in a variety of ways, includes alarm circuitry and a plurality of jacks 23 which transmit a signal from the cable 19 to the alarm. Plugs 21 are safely secured in alarm box 25 by closing the cover 27 of box 25, and by then locking the cover 25 by, for example, a locking system where lock 29 is turned by key 31 to engage locking tab 33. Key 31 also operates a switch 34 which is powered, for example, by a nine volt battery 35. The system is designed to operate in an open circuit condition so that power is not constantly used by the battery. An alarm is sounded via alarm speaker 37 as shown in FIG. 1.

As is noted in the above mentioned U.S. Pat. No. 4,620,182, the cable 19 contains a pair of conductive elements, such as are included in coaxial cable such as COLUMBIA FLEX FOAM 1359, manufactured by Columbia Electronic Cables, of Pawtucket, R.I. Any attempt to cut or otherwise remove the cable causes completion of an electronic circuit which then activates the alarm. Cable 19 is preferably a high memory coiled cable which permits the customer to examine the garment and have a relatively large amount of freedom to move and to view the garment in a mirror, for example, and yet the memory function pulls the coils tight when the cable is not in use to preserve space and avoid entanglement. In the preferred embodiment shown in FIG. 1, there is a 12 straight lead and 28 inches of coiled length providing up to 16 feet in total length.

Figure 2:
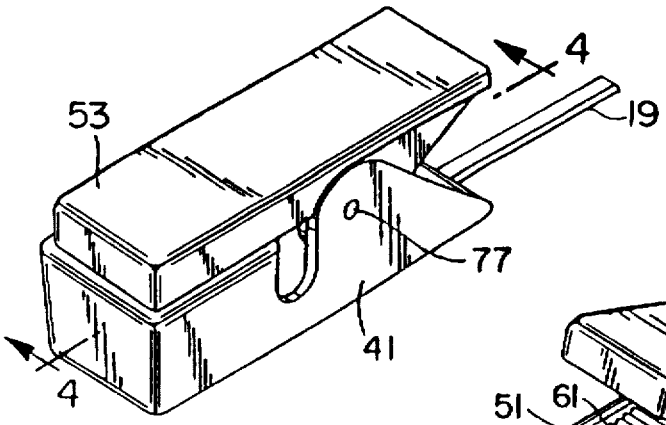
FIG. 2 is an enlarged isometric view showing the electronic security clip device of this invention in a closed or clamping mode.
Figure 3:
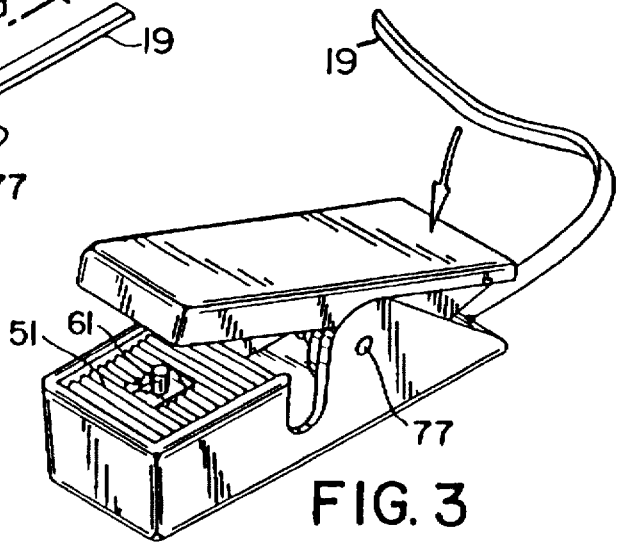
FIG. 3 is an isometric view similar to FIG. 2 but showing the device in an opened unclamping mode.

The clip 17 in FIG. 1 is attached, as will be described in greater detail herein, by pressure on the clip base 41 and upper jaw member 53 in the direction of the arrow shown in FIG. 3, to raise the upper jaw 53 and expose probe 61, which is shown in the face 51 of the lower jaw. FIG. 2 shows the clip in a clipping mode while FIG. 3 shows the unclipping mode or attachment condition.

Figure 5:
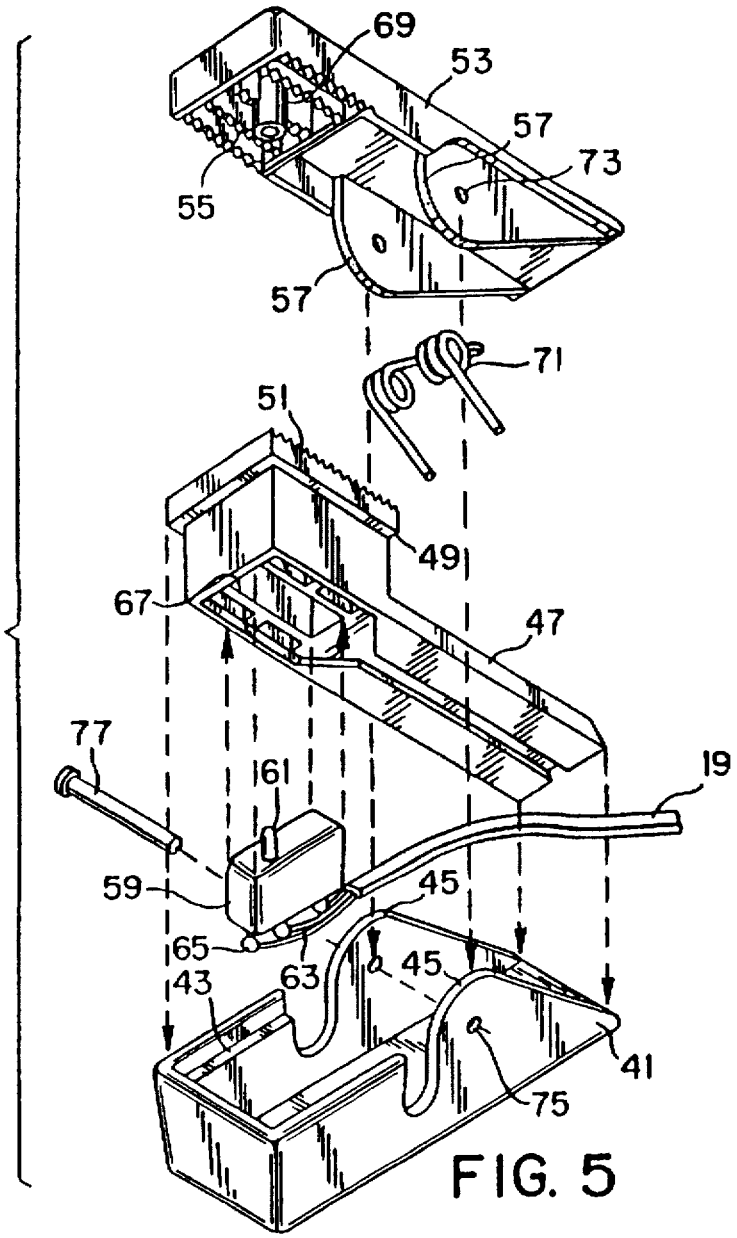
FIG. 5 is an exploded isometric view showing all the component parts of the electronic security clip device of the present invention, prior to assembly.

Turning now to FIG. 5, the construction elements of the clip device are shown in an exploded view prior to assembly. The clip device 17 generally includes a clip base 41, which is formed with a supporting ridge 43 and a pair of upwardly facing cam surfaces 45. Base 41 serves as one side, of the clip. Lower jaw 47 is sized to be fit into clip base 41 such that shoulder 49 is positioned by and rests on supporting ridge 43. Lower jaw 47 has an upwardly facing jaw face 53, previously illustrated in FIG. 3 in the assembled position. Positioned above lower jaw 47 is the upper jaw 53 which has a corresponding downwardly facing face 55. Upper jaw 53 also has a pair of downwardly facing cam surfaces 57 which engage the bottom of clip base 41 as will be described. Of course, if the clip is inverted, the upward and downward directions are reversed, and no structural difference is intended by the descriptions of upper and lower facing and the like. Cable 19 is fully moveable and the likelihood of one jaw or the other being upwardly facing is just about equal and is of no specific concern. Devices of the present invention have been tested and found to be operable in any orientation.

Also shown in FIG. 5 is micro switch 59 which is attached to cable 19. Micro switch 59 includes an upwardly extending, spring biased probe 61 which operates the switch as will be described. Switch 59 is attached to cable 19 via leads 63 and solder junctions 65 or by other conventional electronic connections. Micro switch 59 is held by lower jaw 47 in a specially formed chamber 67 which is sized to receive the switch. Channel 68 allows the cable 19 to be properly protected and away from danger of being pinched during use of the clip.

Figure 4:
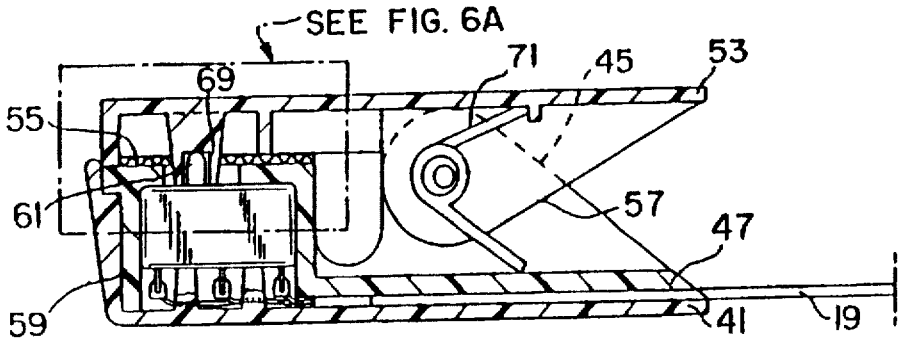
FIG. 4 is an enlarged, sectional elevational view taken along the line 4,4 of FIG. 2.

Upper jaw 53 includes a socket 69 in the downwardly directed face 55 for receiving probe 61 when the device is in the closed mode as shown in FIGS. 2 and 4. As long as switch probe 61 is extended from the body of the micro switch 59, no alarm signal will be given. Spring 71 is held by shaft 77, which is positioned in holes 73 of upper jaw 53 and in holes 75 of clip base 41, so that the jaws pivot with respect to one another on cam surfaces 45 and 57. Normally, spring 71 forces upper jaw 53 away from clip base 41 and applies pressure to pivot shaft 77 so that the upper face 55 and lower face 51 are forced against each other to clamp whatever may be placed therebetween. Pressure on the clip such as shown by the arrow in FIG. 3 causes cam surface 57 to engage the bottom of clip base 41 and pivot the jaw faces apart.

Figure 6A:
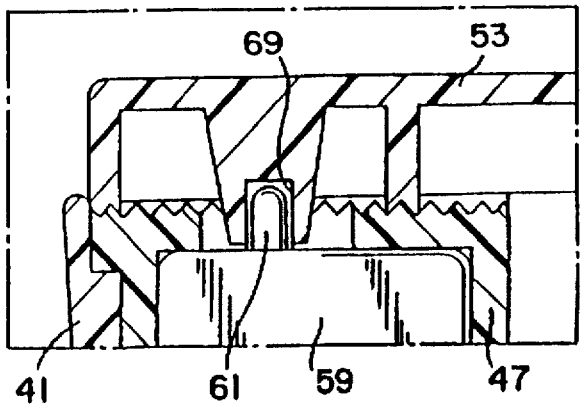
FIG. 6A is an enlarged, fragmentary, sectional view of the details contained within the dot and dash rectangle of FIG. 4 and designated FIG. 6A.
Figure 6B:
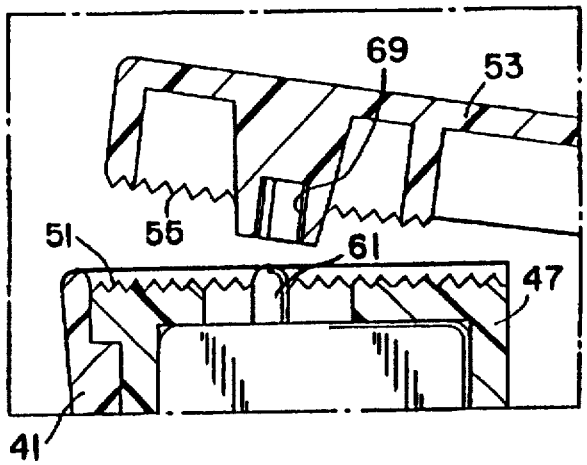
FIG. 6B is a view similar to FIG. 6A but showing a micro switch in a normally closed position.
Figure 6C:
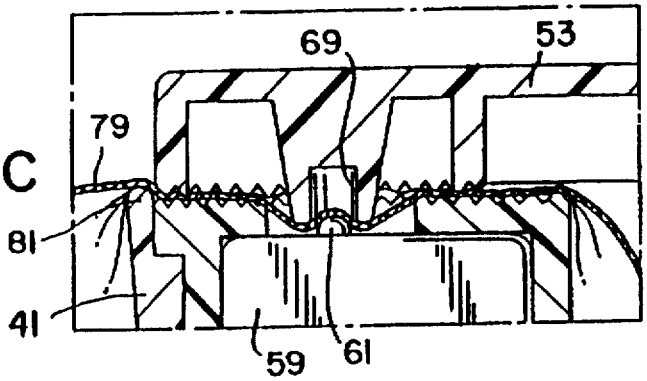
FIG. 6C is another view similar to FIG. 6A but showing a web of fine fabric inserted into the device.

Turning now to FIGS. 6A, 6B and 6C, the operation of the clip device of the present invention is shown. Prior to use, probe 61 is located in socket 69 and spring 71 keeps the two jaws in a normally closed position. Pressure as previously describes is then used to open the jaws, as seen in FIG. 6B. A fabric 79 or garment or other object is then placed between face 55 of jaw 53 and face 51 of jaw 47 to be engaged as shown in FIG. 6C, where fabric 79 causes probe 61 to be pushed into micro switch 59, thereby causing the switch to operate. As long as probe 61 remains in the alarm armed position shown in FIG. 6C, the garment or other object is secure. If the clip is pressed to open the jaws, probe 61 will pop out of the switch 59, thereby sending the alarm signal to the appropriate alarm box or other part of the system as desired. Similarly, if a customer or other person attempts to slide the fabric 79 out from between the jaws 47 and 53, without opening the jaws, the irregular face of jaw faces 51 and 55 will resist such sliding movement. Nevertheless, if the fabric 79 is removed, even without disturbing jaws 47 and 53, probe 61 will still pop up into socket 69 to then send the same alarm signal.

The only way an alarm signal can be prevented from sounding the alarm is to deactivate the alarm prior to removing the clip. This is, of course, the intended purpose of the present invention, in that customers can try on a variety of garments at their leisure and in relative privacy without the sales clerk being directly present. The length of the cable allows for all the freedom that is needed for normal shopping. Nevertheless, an alarm will sound if the cable is cut or if the clip is removed from the garment, thus insuring security protection for the garment.

At the time when a particular garment is selected, the sales clerk is called and the garment can be removed from the system. Specifically, the clerk deactivates the alarm, such as by turning key 31 to the off position, and then the clip can be depressed to open the jaws and remove the garment. The clerk may then remove the appropriate plug 21 from jack 23 and activate the alarm by turning key 31 to the "ON" position. Alternatively, the clerk may insert an object into the clip and then close the clip before turning the alarm on again. In this manner, the clip can then hang until additional inventory can be brought to the display fixture. As long as probe 61 is depressed, the alarm will not be activated and no alarm signal will be sent to the alarm box 25. Probe 61 is spring biased to remain outside the switch 59 absent additional force.

Figure 7:
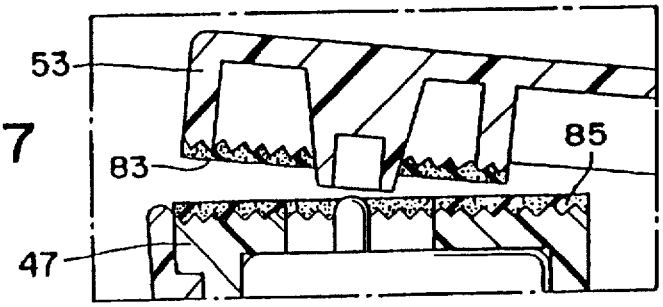
FIG. 7 is a view similar to FIG. 6C but showing a modification to the clamping faces of the jaws.

In order to further protect the objects being held by the clip device of the present invention, it is necessary to prevent intentional disablement of the switch by one trying to frustrate the intention of the security device described herein. As shown in FIG. 6C, the outer edge 81 of clip base 41 extends above the plane defined by the faces 51 and 55 of jaws 47 and 53 respectively. Accordingly, it is not possible to insert a card or other stiff device between the fabric 79 and the probe 61 to prevent the probe from exiting into socket 69 and sending the alarm signal when fabric 79 is pulled from the two jaws. Without lip or outer edge 81, some card or another substitute fabric could possibly be inserted between fabric 79 and probe 61 to thwart the intentions of the device. Another safety feature is shown in FIG. 7, where layers of foam rubber 83 and 85 are placed on faces 51 and 55 respectively, to prevent the slidable insertion of another surface and to prevent the slidable release of the garment fabric 79. Depending upon the degree of concern and the willingness to accept false alarms, it is possible to adjust the sensitivity of probe 61 and switch 59 so that more or less movement of probe 61 into switch 59 for setting the alarm condition or back out of the switch to trigger the sending of the alarm signal will be needed.

It has also been discovered that it is important that the cable be attached to the goods in a manner that does not easily become unattached by accident or misadventure. The clip should not disengage merely upon a single action by a person inspecting the goods to which it is attached. As shown in FIG. 3, mere pressure in the direction of the arrow on the distal end of the upper jaw member 53 will cause a separation of the jaws and, if the circuits have not been disconnected, the sounding of an alarm. While a principle purpose for the invention is to sound an alarm when someone is attempting to remove the goods being protected without authorization, it is not desirable to have false alarms or accidental disturbances caused merely by a potential customer examining the goods.

Figure 8A:
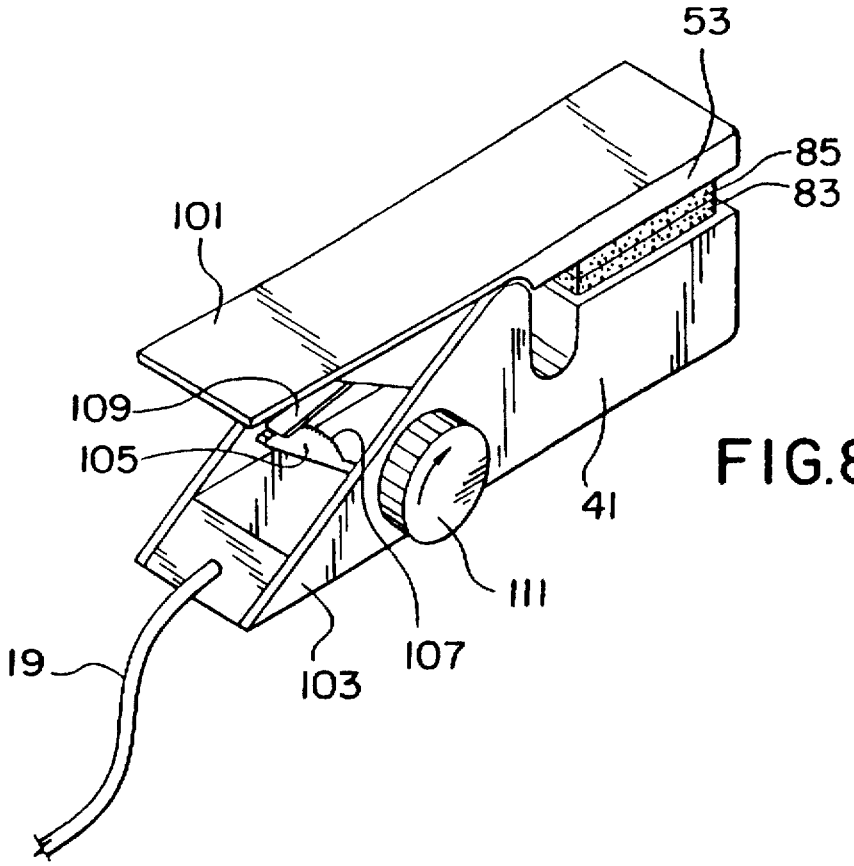
FIG. 8A is an isometric view showing the electronic security clip of the present invention in a closed and locked position, illustrating one locking embodiment.
Figure 8B:
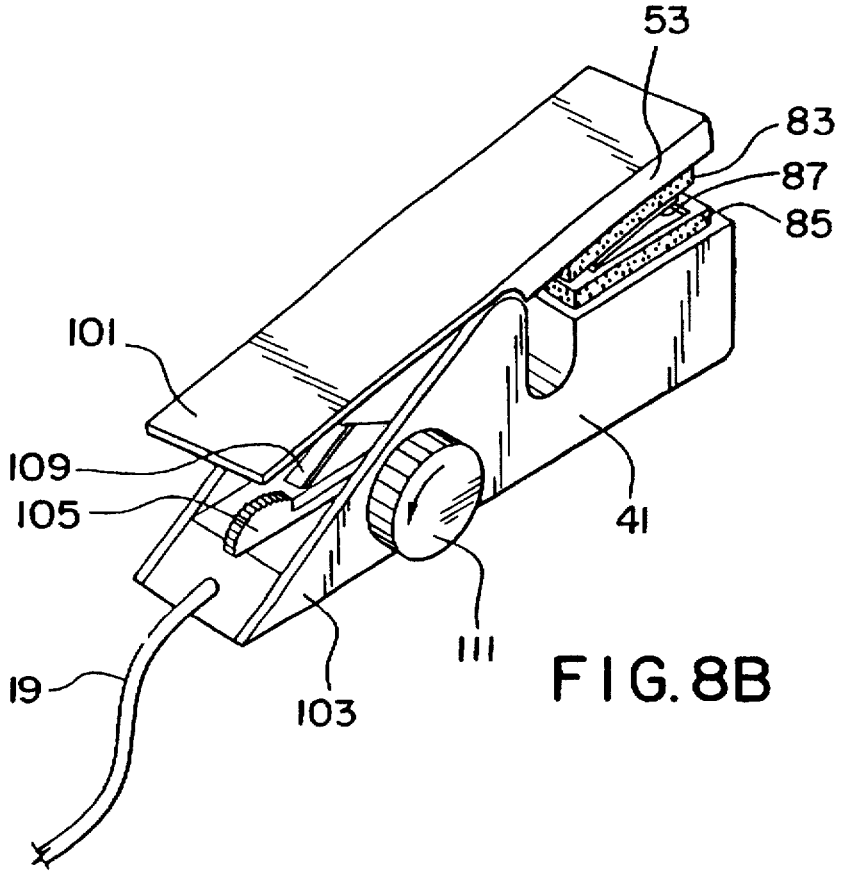
FIG. 8B is an isometric view similar to FIG. 8A, but showing the device in an unlocked and open position.

Turning now to FIGS. 8A and 8B, a first embodiment is shown illustrating a means for selectively moving between a first condition which prevents relative movement of the jaws with respect to one another and a second condition permitting relative movement therebetween. Upper jaw 53 includes a top distal end 101 at the opposite end from the proximal end which engages the product or goods between upper jaw 53 and lower jaw 41. Similarly, the bottom jaw 41 includes a bottom distal end 103. Positioned between the distal ends 101 and 103 is a ratchet 105 having a plurality of teeth 107 or steps for engagement with pawl or detent 109. Knob 111 is mounted to the ratchet 105 and can be rotated in both directions as shown in the two figures. To install the clip, the knob 111 is rotated to bring the ratchet 105 away from pawl 109, opening the gap between the foam rubber upper jaw 83 and foam rubber lower jaw 85, and foam socket 87. The goods are then placed between upper jaw 53 and lower jaw 41 and pressure is released from distal ends 101 and 103, so that the clip engages the goods being protected. At this point, knob 111 is rotated in the direction shown in FIG. 8A so that the teeth 107 of ratchet 105 engage pawl 109. Thus the product is held securely and inadvertent pressure on either distal end 101 or 103, or both, will not inadvertently cause the jaws to be open and cause a false alarm. Knob 111 is not protected from intentional movement and ratchet 105 can easily be disengaged from pawl 109 by turning knob 111 as shown in FIG. 8B. If this is done by a sales person or other authorized employee, the alarm should be disengaged by lock and key to open lid 27 and the goods removed for purchase by the customer. If knob 111 is rotated to free ratchet 105 from pawl 109 by someone not authorized to do such, the clip is still in the "alarm ready" condition and removal of the goods will cause the alarm to sound. This embodiment permits all of the features of the present invention to be enjoyed without the misadventure of false alarms.

Figure 9A:
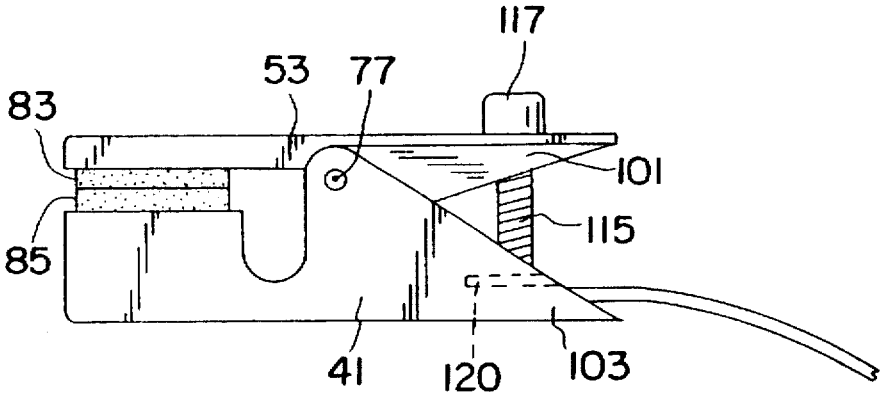
FIG. 9A is an isometric view showing the electronic security clip in a closed and locked position, illustrating a second locking embodiment.
Figure 9B:
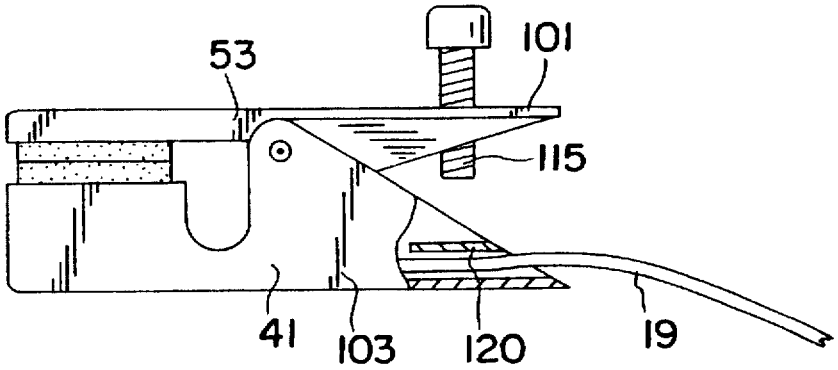
FIG. 9B is an isometric view similar to FIG. 9A, but showing the device in an unlocked and closed position.
Figure 9C:
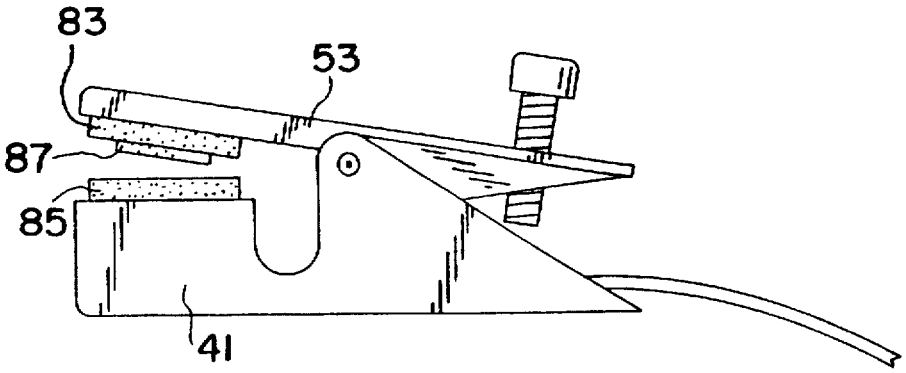
FIG. 9C is an isometric view similar to FIGS. 9A and 9B, but showing the device in an unlocked and open position.

Turning now to FIGS. 9A, 9B and 9C, a second embodiment providing a locking means on the jaws is shown. In this embodiment, again the jaws are selectively moveable between a first condition preventing relative movement of the jaws with respect to one another and a second condition permitting that relative movement. The relationship of upper jaw 53 and lower jaw 41 and the relative movement therebetween is determined by threaded bolt 115 which is threaded through a hole in top distal end 101 by rotation of a knob 117 on bolt 115. In FIG. 9A, bolt 115 is threaded all the way into the top distal end 101 so that it is in contact with plate 120, shown in dash lines in distal end 103. Clearly, the pressure on the two distal ends will not overcome the movement preventing condition achieved by threaded bolt 115. To remove goods from between upper jaw 53 and lower jaw 41, bolt 115 is rotated in the reverse direction by turning knob 117 to separate the end of bolt 115 from plate 120 shown with distal end 103 cut away. In FIG. 9C, this separation permits operation of the jaws, as shown, to permit attachment of the clip to goods or removal, either authorized or unauthorized and, in the later case, to cause the alarm to sound.

While particular embodiments of the present invention have been illustrated and described, it is not intended to limit the invention, except as defined by the following claims.

What is claimed is:

1. An electronic security clip device for use with electronic security systems, comprising:

cable and alarm means for transmitting an alarm signal to an electronic security system; and clip means including a pair of opposing jaws pivotally mounted so as to normally be in a closed position; said clip means positioning said cable and alarm means in operable relationship to said jaws;

said cable and alarm means including switch means for activating said alarm means upon placement of an object between said jaws, whereby removal of said object causes said switch to trigger said cable and alarm means to transmit said alarm signal;

wherein said clip means comprises a clip base having an upwardly facing cam surface and a support ridge, a lower jaw mounted on said clip base and having a support-ridge-engaging shoulder for positioning said lower jaw in said clip base, said lower jaw including a lower jaw face and a chamber means for positioning said cable and alarm means in operable relationship to said lower jaw face, a upper jaw pivotally mounted on said clip base and having a downwardly facing cam surface for mutual engagement with said clip base, said upper jaw having an upper jaw face aligned to engage said lower jaw face, and biasing means for positioning said upper and lower jaws in a normally closed position wherein said upper jaw face engages said lower jaw face, said upwardly facing cam surface and said downwardly facing cam surface being aligned to permit separation of said upper jaw and lower jaw upon pressure to overcome said biasing means;

locking means for said jaws movable between a first position for preventing movement of said jaws relative to one another and a second position for permitting said movement; and said locking means comprising a rotatable bolt operable to rotate in one of said distal ends for contact with the other of said distal ends whereby when said bolt is fully threaded into said one distal end, the jaws are in a locked position.

2. An electronic security clip device for use with electronic security systems, comprising:

cable and alarm means for transmitting an alarm signal;

a clip base having an upwardly facing cam surface and a support ridge;

a lower jaw mounted on said clip base and having a support-ridge-engaging shoulder for positioning said lower jaw in said clip base, said lower jaw including a lower jaw face and a chamber means for positioning said cable and alarm means in operable relationship to said lower jaw face;

an upper jaw pivotally mounted on said clip base and having a downwardly facing cam surface for mutual engagement with said clip base, said upper jaw having an upper jaw face aligned to engage said lower jaw face;

biasing means for positioning said upper and lower jaws in a normally closed position wherein said upper jaw face engages said lower jaw face, said upwardly facing cam surface and said downwardly facing cam surface being aligned to permit separation of said upper jaw and lower jaw upon pressure to overcome said biasing means;

said cable and alarm means including switch means including a spring biased probe extending from said lower jaw toward said upper jaw, said upper jaw having a probe-receiving socket for receiving said probe in said normally closed position, said probe being adapted to be moved inward to activate said alarm means upon placement of an object between said upper jaw face and said lower jaw face, whereby removal of said object causes said probe to trigger said alarm means to transmit said alarm signal;

locking means for said jaws movable between a first position for preventing movement of said jaws relative to one another and a second position for permitting said movement; and said locking means comprising a rotatable bolt operable to rotate in one of said distal end for contact with the other of said distal ends whereby when said bolt is fully threaded into said one distal end, the jaws are in a locked position.

3. An electronic security system for use with garments and the like, comprising:

an electronic alarm box having a plurality of cable receiving means, said alarm box being adapted to sound an alarm upon receipt of an alarm signal;

at least one cable, connected to the alarm box; and an electronic security clip device, said device including;

alarm means, connected to the cable, for generating an alarm signal; and clip means including a pair of opposing jaws pivotally mounted so as to normally be in a closed position, said clip means positioning said alarm means in operable relationship to said jaws;

wherein said alarm means is activated upon placement of an object between said jaws, whereby removal of said object causes said alarm means to transmit said alarm signal;

wherein said clip device comprises a clip base having an upwardly facing cam surface and a support ridge, a lower jaw mounted on said clip base and having a support-ridge-engaging shoulder for positioning said lower jaw in said clip base, said lower jaw including a lower jaw face and a chamber means for positioning said cable and alarm means in operable relationship to said lower jaw face, an upper jaw pivotally mounted on said clip base and having a downwardly facing cam surface for mutual engagement with said clip base, said upper jaw having an upper jaw face aligned to engage said lower jaw face, and biasing means for positioning said upper and lower jaws in a normally closed position wherein said upper jaw face engages said lower jaw face, said upwardly facing cam surface and said downwardly facing cam surface being aligned to permit separation of said upper jaw and lower jaw upon pressure to overcome said biasing means;

locking means for said jaws movable between a first position for preventing movement of said jaws relative to one another and a second position for permitting said movement; and said locking means comprising a rotatable bolt operable to rotate in one of said distal ends for contact with the other of said distal ends whereby when said bolt is fully threaded into said one distal end, the jaws are in a locked position.

4. An electronic security clip device to protect garments and the like, for use with electronic security systems which are activated by an alarm signal, comprising;

clip means including a pair of pivotally mounted opposing jaws, each having a jaw face, the jaws being biased so that the faces are in a normally closed position and are substantially diametrically opposed to each other to define a plane between the faces in their closed position;

switch means fixedly located within one jaw, for controlling the alarm signal, the switch means including a pressure-responsive depressible actuator projecting outwardly from the switch means towards the plane;

a socket extending from the jaw opposite the switch means and dimensioned to receive the actuator, whereby the actuator, in operable relationship with the socket, is generally depressed upon the securement of a garment between the jaws, prohibiting actuation of the switch means, and upon removal of the garment the actuator substantially distends, generating the alarm signal, and wherein the secured garment allows a partial distention of the actuator into the socket, thereby hindering the insertion of a foreign object between the actuator and the socket which prevents the circumvention of the switch means;

cable means for transmitting the alarm signal from the switch means to the electronic security system;

locking means for said jaws movable between a first position for preventing movement of said jaws relative to one another and a second position for permitting said movement; and said locking means comprising a rotatable bolt operable to rotate in one of said distal ends for contact with the other of said distal ends whereby when said bolt is fully threaded into said one distal end, the jaws are in a locked position.

5. An electronic security clip device to protect merchandise, for use with an electronic security system activated by an alarm signal, comprising:

switch means for controlling the alarm signal;

cable means for transmitting the alarm signal from the switch means to the electronic security system;

a pair of pivotally mounted jaws biased in a closed position, having confronting faces disposed in a common plane when in a closed position, the switch means being in operable relationship with said jaws upon the placement of merchandise between the jaws, wherein the removal of said merchandise causes the switch means to generate the alarm signal thereby activating the electronic security system;

a lip extending from the one of said jaws and through said common plane, preventing the circumvention of the switch means by insertion of a foreign object;

locking means for said jaws movable between a first position for preventing movement of said jaws relative to one another and a second position for permitting said movement; and said locking means comprising a rotatable bolt operable to rotate in one of said distal ends for contact with the other of said distal ends whereby when said bolt is fully threaded into said one distal end, the jaws are in a locked position.

* * * * *